US009591908B2

(12) United States Patent
Kim et al.

(10) Patent No.: US 9,591,908 B2
(45) Date of Patent: Mar. 14, 2017

(54) PRESS-TYPE DISPENSING CONTAINER

(71) Applicant: AA R&D LLC, Leonia, NJ (US)

(72) Inventors: Asher T. Kim, Fort Lee, NJ (US); Aiden T. Kim, Fort Lee, NJ (US)

(73) Assignee: AA R&D LLC, Leonia, NJ (US)

( * ) Notice: Subject to any disclaimer, the term of this patent is extended or adjusted under 35 U.S.C. 154(b) by 94 days.

(21) Appl. No.: 14/300,375

(22) Filed: Jun. 10, 2014

(65) Prior Publication Data

US 2015/0289628 A1 Oct. 15, 2015

Related U.S. Application Data

(60) Provisional application No. 61/979,747, filed on Apr. 15, 2014.

(51) Int. Cl.

| | |
|---|---|
| ***A45D 40/02*** | (2006.01) |
| ***A45D 34/06*** | (2006.01) |
| ***A46B 17/04*** | (2006.01) |
| ***A61K 8/19*** | (2006.01) |
| ***A46B 11/00*** | (2006.01) |
| ***B65B 3/04*** | (2006.01) |
| ***B65D 83/00*** | (2006.01) |
| *A45D 40/00* | (2006.01) |

(52) U.S. Cl.

CPC ..... *A45D 40/02* (2013.01); *A45D 40/0087* (2013.01); *B65D 83/0033* (2013.01); *B65D 83/0038* (2013.01); *B65D 83/0077* (2013.01); *A45D 2040/0025* (2013.01)

(58) Field of Classification Search

CPC .... B43K 24/02; A45D 40/02; A45D 40/0087; A47K 5/08; B65D 83/0033; B65D 83/0038; B65D 83/0077

USPC ..... 222/386; 401/183–186, 205–206

See application file for complete search history.

(56) References Cited

U.S. PATENT DOCUMENTS

| | | | | | |
|---|---|---|---|---|---|
| 2,767,834 | A * | 10/1956 | Sherman | A45D 40/16 | 206/385 |
| 3,317,036 | A * | 5/1967 | Cherba | A45D 40/06 | 132/320 |
| 3,655,290 | A * | 4/1972 | Griffith | A45D 34/042 | 401/186 |
| 4,621,935 | A * | 11/1986 | Sussman | A45D 40/02 | 220/200 |
| 6,071,027 | A * | 6/2000 | Gueret | A45D 40/04 | 401/68 |

(Continued)

OTHER PUBLICATIONS

Notification Concerning Transmittal of International Preliminary Report on Patentability (Form PCT/IB/326) issued in counterpart International Application No. PCT/US2014/041639 dated Oct. 27, 2016, with Forms PCT/IB/373 and PCT/ISA/237. (6 pages).

*Primary Examiner* — Mark A Laurenzi
*Assistant Examiner* — Thomas M Abebe
(74) *Attorney, Agent, or Firm* — Westerman, Hattori, Daniels & Adrian, LLP

(57) ABSTRACT

A press-type dispensing container that includes an outer case that includes a hollow tube portion and a compressible region; and an inner member including a support portion that is configured to support a personal care product, wherein the inner component is contained within the outer case and is configured to migrate towards the shaft portion when the compressible region of the outer case is compressed by a user is presented.

16 Claims, 5 Drawing Sheets

(56) References Cited

U.S. PATENT DOCUMENTS

| | | | | |
|---|---|---|---|---|
| 7,651,291 | B2 * | 1/2010 | Py | B65D 35/28 401/11 |
| 8,613,286 | B2 * | 12/2013 | Kennedy | A45D 40/02 132/320 |
| 2004/0042840 | A1 * | 3/2004 | Thiebaut | B29C 45/1705 401/266 |
| 2004/0163663 | A1 * | 8/2004 | Cooper | A45D 40/24 132/297 |
| 2005/0279776 | A1 * | 12/2005 | Decottignies | B65D 1/32 222/386 |
| 2008/0044218 | A1 * | 2/2008 | Py | B65D 35/28 401/110 |
| 2008/0298876 | A1 * | 12/2008 | Porter | A45D 34/04 401/17 |
| 2009/0123217 | A1 * | 5/2009 | Ross | A45D 44/18 401/134 |
| 2010/0175777 | A1 * | 7/2010 | Laskowski | B65D 35/30 141/2 |
| 2010/0260532 | A1 * | 10/2010 | Tsai | A45D 34/042 401/183 |
| 2011/0286782 | A1 * | 11/2011 | Castellani | A45D 34/04 401/125 |
| 2013/0108350 | A1 * | 5/2013 | Ulrich | A45D 34/06 401/18 |
| 2014/0016988 | A1 * | 1/2014 | Bow | A61J 3/00 401/206 |
| 2014/0124541 | A1 * | 5/2014 | Mathiez | A45D 34/04 222/207 |
| 2015/0007845 | A1 * | 1/2015 | Teboul | A45D 19/0008 132/200 |

* cited by examiner

PRESS-TYPE DISPENSING CONTAINER

CROSS-REFERENCE TO RELATED APPLICATIONS

This application claims the benefit of U.S. Provisional Application No. 61/979,747, filed Apr. 15, 2014, the contents of which are incorporated herein by reference.

FIELD OF THE INVENTION

The present invention relates to a dispensing container. More specifically, the present invention relates to a press-type dispensing container for solid, semi-solid, or waxy personal care products.

BACKGROUND

Existing packages or containers for solid, semi-solid, or waxy personal care products (e.g. lipsticks, deodorants, and the like) are used by opening the cap and rotating the package to lower or raise the product. Such items typically include a cylindrically-shaped package which is maneuvered by rotating an outer shaft. As the formulation of the product is usually a soft material, it is required that the product protrude as little as possible from the package to prevent breaking of the product while it is being applied. Due to this limitation, traditional packages have complicated parts and complicated assemblies. Improvements in the usability and cost for these packages have been stale. Also, personal care products are trending towards softer compositions and require air-tight packages to accommodate these changes, which is difficult for existing packages to accomplish.

SUMMARY OF THE DISCLOSED SUBJECT MATTER

There is provided in accordance with various embodiments of the invention a press-type dispensing container that includes an outer case defining a hollow tube portion which is open at one end and extends toward a compressible region at the opposite end. An inner member including a support portion that is configured to support a personal care product is positioned within the hollow tube portion of the outer case. The support portion is configured to migrate towards the tube portion open end when the compressible region of the outer case is compressed.

In at least one embodiment, the hollow tube portion is configured to receive a cap or lid.

In at least one embodiment, the container includes a personal care product in contact with the support portion. In an exemplary embodiment, the personal care product is selected from cosmetic, pharmaceutical, and cosmeceutical compositions. In one embodiment, the personal care product includes a cosmetic composition selected from lipstick, lip balm, blush, foundation, eye shadow, concealer, eye liner, lip liner, deodorant, soap, fragrance, and sunscreen compositions. In another embodiment, the personal care product includes a pharmaceutical composition. In yet another embodiment, the personal care product includes a cosmeceutical composition.

In at least one embodiment, the inner member further includes a flexible material selected from cross-linked latex rubber, cross-linked synthetic elastomers, non-cross-linked synthetic elastomers, natural rubber, thermoplastic elastomers, PVC, synthetic rubber, polyurethane, latex rubber, synthetic latex rubber, and polyolefins.

In at least one embodiment, the inner member further includes a hollow flexible outer portion surrounding an inner fluid portion.

In yet another embodiment, the inner member further includes a fluid and sealing component. In at least one embodiment, the sealing component is disposed within the shaft portion of the outer case.

In at least one embodiment, the inner member further includes a rigid material and a spring. In at least one embodiment, the spring is disposed within the tube portion of the outer case.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
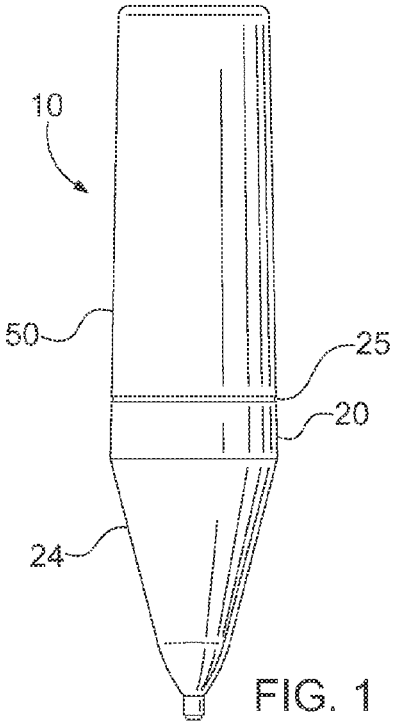
FIG. 1 is an elevation view of a press-type dispensing container in accordance with an exemplary embodiment of the present invention with a cap positioned thereon.

The press-type dispensing container described herein extends the use of a tube-type package to solid, semi-solid, or waxy compositions. Until now, tube-type packages have been limited to dispensing liquids. The container described herein provides product dispensing and storage functions via a streamlined design that utilizes a minimal number of parts. In certain embodiments, airtight storage is also achieved.

In the drawings, like numerals indicate like elements throughout. As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

As used herein, the term "personal care product" includes, but is not limited to, solid, semi-solid, or waxy cosmetic, pharmaceutical (e.g. dermatological), or cosmeceutical compositions. Cosmetic products include preparations that can be applied to a user's body for the purpose of altering the quality or appearance of an application site. Exemplary cosmetic products include, but are not limited to, lipstick, lip balm, blush, foundation, eye shadow, concealer, eye liner, lip liner, deodorant, soap, fragrance, and sunscreen compositions. Pharmaceutical products include compositions that can be applied to a user's body for the purpose of ameliorating a disease or condition (for example, dermatological) in the user.

Figure 2A:
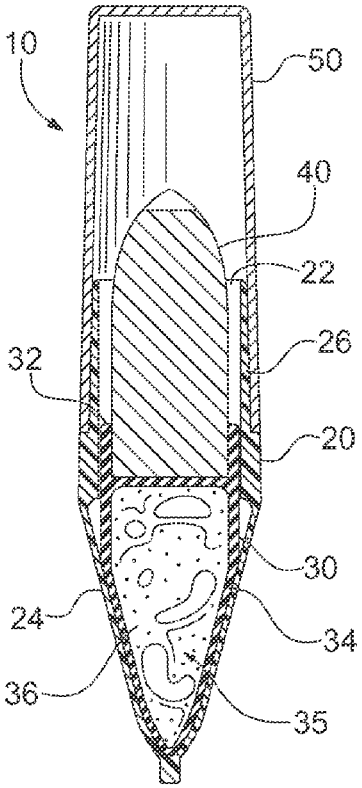
FIG. 2A is a cross-sectional view of the container of FIG. 1.
Figure 2B:
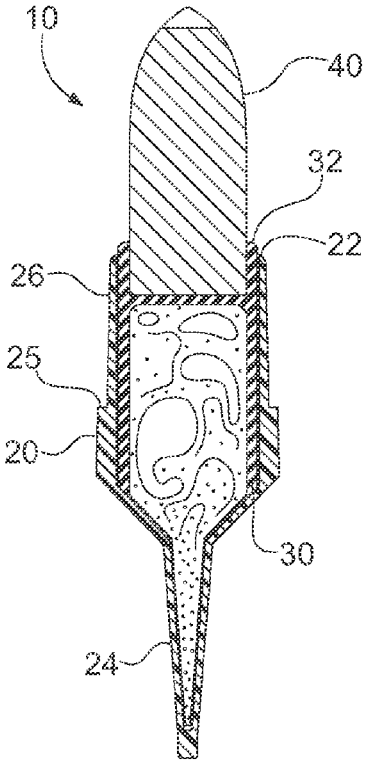
FIG. 2B is a cross-sectional view similar to FIG. 2A illustrating the press-type dispensing container in a compressed condition and the cap removed.

Referring to FIGS. 1-2B, a press-type dispensing container 10 in accordance with an exemplary embodiment of the invention will be described. The container 10 includes an outer case 20 which defines a hollow tube portion 26 and a compressible region 24. The hollow tube portion 26 includes an opening 22 through the end opposite the compressible region 24. A shoulder 25 may be defined into the outer case 20 such that it defines a seat for the optional cap 50.

An inner member 30 is positioned within the outer case 20 and includes a support portion 32 that is configured to support a personal care product 40 so that the product 40 can be stored within the container 10 or dispensed through the opening 22 in the outer case 20. The support portion 32 of the inner component 30 can be configured to support a personal care product 40 of any desired shape. In one embodiment, when the personal care product 40 is a stick form, exemplary shapes for a cross-section of the stick include, but are not limited to, round, square, rectangular, oval, elliptical, hexagonal, and triangular shapes. The hollow tube portion 26 preferably has an internal shape which complements the shape of the support portion 32 for guided motion of the support portion 32 within the hollow tube portion 26. The opening 22 is illustrated to have an inner diameter equal to or larger than the outer diameter of the support portion 32 such that the support portion 32 may extend at least partially through the opening 22. Alternatively, the opening 22 may have a smaller inner diameter such that it acts as a stop and prevents passage of the support portion 32 therethrough.

In the present embodiment, the inner member 30 also includes a flexible portion 34 which defines a chamber 35 below the support portion 32. When the inner member 30 is positioned within the outer case 20, the flexible portion 34 is positioned at least partially within and partially aligned with the compressible region 24 of the outer case 20. Within the chamber 35 is a driving element 36, which in the present embodiment is a flexible or elastic material. More specifically, the flexible or elastic material is one in which at least a portion of it is: (a) capable of migrating or spreading when another portion of the material is compressed and (b) retracting towards its original state when the compressive force is reduced or stopped. Any material that fits this description is suitable. Exemplary materials include, but are not limited to, gel and non-gel elastomers and/or higher-durometer elastomers. Preferred materials include cross-linked latex rubber, cross-linked and non-cross-linked synthetic elastomers of many types (SANTOPRENE™ of any grade, KRATON™ of any grade, SEPTON™ of any grade, isoprene, butadiene, silicone rubber, thermoset or thermoplastic polyurethane and many others), natural rubber, thermoplastic elastomers, PVC, synthetic rubber, polyurethane, latex rubber, synthetic latex rubber, polyolefin, or any other flexible or elastic material.

While the compressible drive element 36 of the present embodiment is illustrated within the flexible portion 34, it is also contemplated that the flexible portion 34 may be eliminated and the flexible or elastic material of the driving element 36 may simply be positioned within the flexible portion 24 of the outer case 20 and in contact with the non-supporting surface of the support portion 32. Such flexible or elastic material could be formed independent from the support portion 32 or integral therewith.

Referring to FIG. 2B, the product 40 is dispensed by compressing the compressible region 24 of the outer case 20, for example by squeezing or pinching, which in turn compresses the drive element 36, causing a portion of the flexible or elastic material to migrate toward the non-compressed area within the tube portion 26 of the outer case 20. Migration of the flexible or elastic material drives the support portion 32 toward the opening 22 in the outer case 20, which in turn pushes the product 40 out of opening 22. When the user reduces or stops applying a compressive force to the compressible region 24, the inner component 30 returns to its original state and the product 40 is retracted back into the hollow tube portion 26.

Figure 3A:
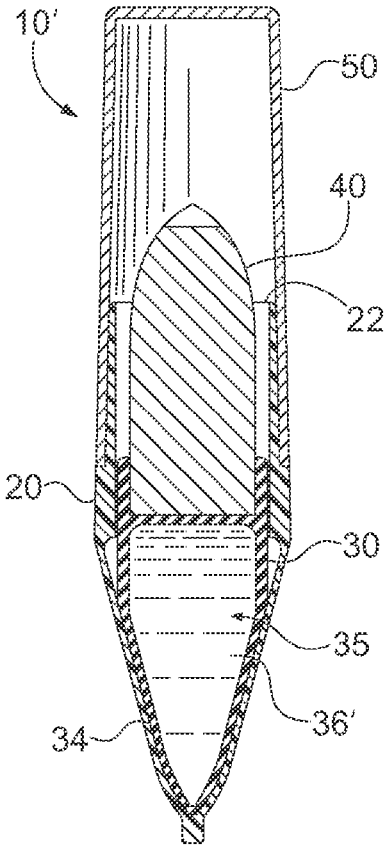
FIGS. 3A and 3B are cross-sectional side views similar to FIGS. 2A and 2B, respectively, of a press-type dispensing container in accordance with another exemplary embodiment of the invention.
Figure 3B:
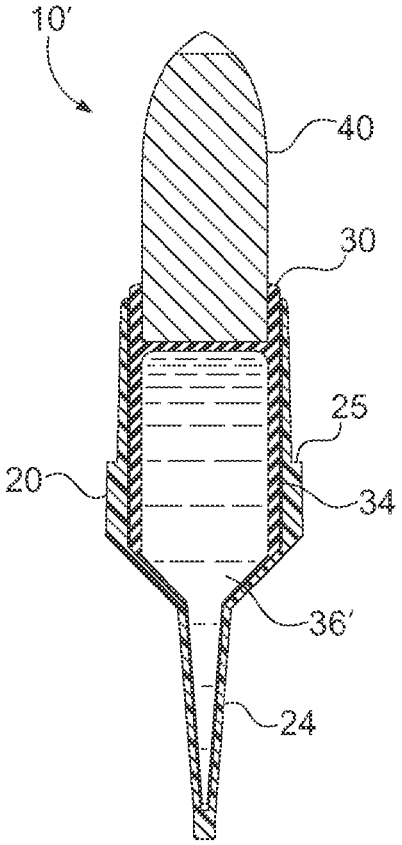

Referring to FIGS. 3A and 3B, a press-type dispensing container 10' in accordance with another exemplary embodiment of the invention will be described. The press-type dispensing container 10' is substantially the same as in the previous embodiment except that the drive element 36' is a fluid rather than a flexible or elastic material. The fluid is contained within the chamber 35. Exemplary fluids which define the drive element 36' of the present embodiment may include gases (e.g. air) or liquids (e.g. aqueous or nonaqueous liquids). Preferred fluids include air or water. In all other respects, the press-type dispensing container 10' operates in a manner similar to that described with respect to the first exemplary embodiment.

Figure 4A:
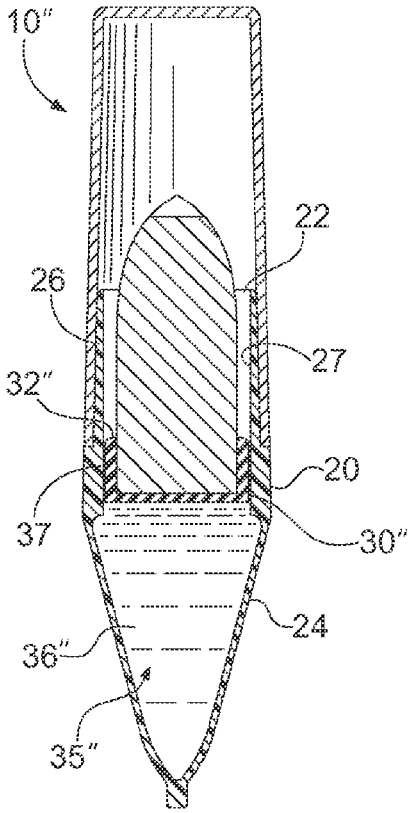
FIGS. 4A and 4B are cross-sectional side views similar to FIGS. 2A and 2B, respectively, of a press-type dispensing container in accordance with another exemplary embodiment of the invention.
Figure 4B:
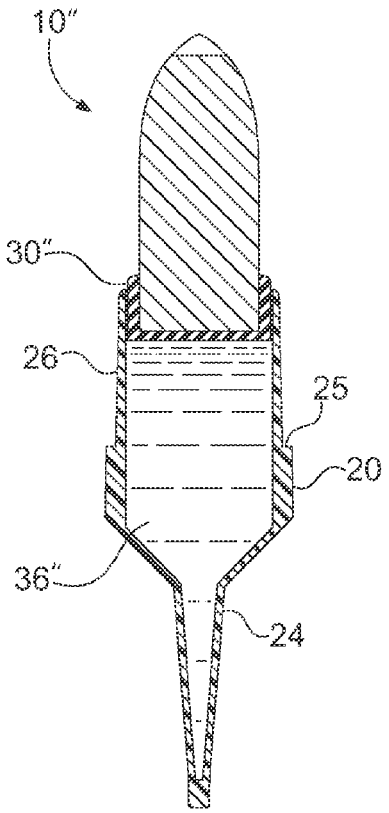

Referring to FIGS. 4A and 4B, a press-type dispensing container 10" in accordance with another exemplary embodiment of the invention will be described. The present embodiment is similar to the previous embodiments and includes an outer case 20 with a hollow tube portion 26 defining an open end 22 and a compression region 24. In the present embodiment, the inner member 30" does not include a flexible portion, but only includes the support portion 32". The support portion 32" is configured to sealingly engage an inside surface 27 of the hollow tube portion 26 such that a fluid tight chamber 35" is defined between the inner member 30" and the outer case 20. In the present embodiment, the drive element 36" is a fluid similar to the previous embodiment. The sealed interaction between the support portion 32" and the inside surface 27 prevent the fluid from leaking out of the container 10" when the container 10" is in a storage state or when the compression region 24 is compressed. In all other respects, the press-type dispensing container 10" operates in a manner similar to that described with respect to the previous exemplary embodiments.

Figure 5A:
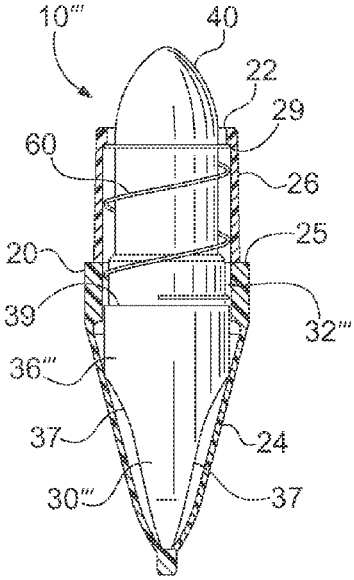
FIGS. 5A-C are cross-sectional views an uncapped press-type dispensing container in accordance with another exemplary embodiment of the invention illustrating sequential operation of the dispenser.
Figure 5B:
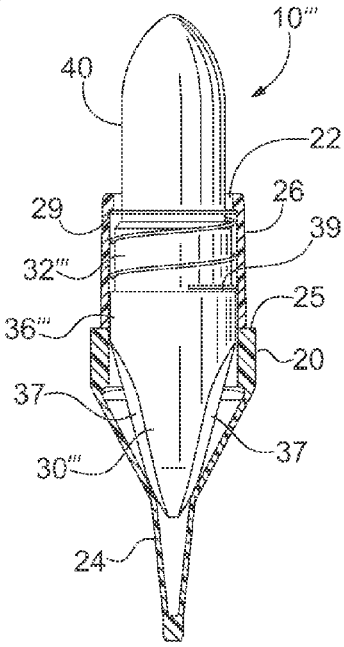
Figure 5C:
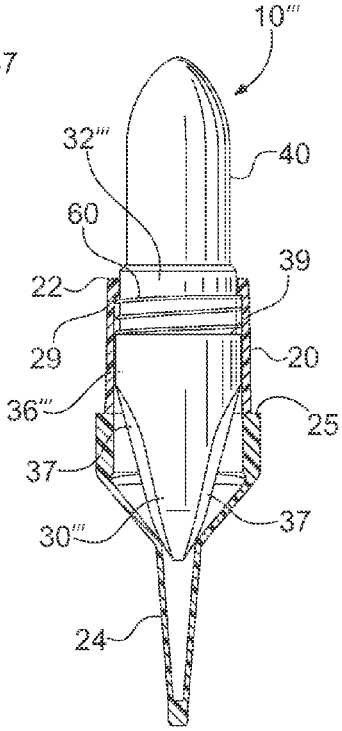

Referring to FIGS. 5A-C, a press-type dispensing container 10''' in accordance with another exemplary embodiment of the invention will be described. The container 10''' again includes an outer case 20 with a hollow tube portion 26 defining an open end 22 and a compression region 24. The inner member 30''' is positioned within outer the case 20 and includes a support portion 32''' and a drive element 36'''. The support portion 32''' is again configured to support a personal care product 40 of any desired shape. In the present embodiment, the drive element 36''' is a rigid material with opposed tapered sides 37 such that the drive element 36''' will cause the inner member 30''' to migrate (e.g. slide) towards the opening 22 of the tube portion 26 when the compressible region 24 of outer case 20 is compressed. Such motion is illustrated progressively in FIGS. 5A-C.

To insure return of the inner member 30''' upon release of the compressive force, a spring 60 is positioned within the tube portion 26 between an inward shoulder 29 defined adjacent the opening 22 and a shoulder 39 defined between the support portion 32''' and the drive element 36'''. The spring 60 is compressed when inner component 30''' migrates towards or into the tube portion 26 (FIGS. 5B and 5C) and expands towards its original state when the compressive force is reduced or released (FIG. 5A). Expansion of the spring 60 in this way causes the product 40 to be retracted back into tube portion 26 for storage.

While the support portion 32''' and the drive element 36''' are illustrated as an integral component, it is contemplated that they may be formed as separate components. In such an embodiment, the shoulder 39 may be defined in the support portion alone.

Figure 6:
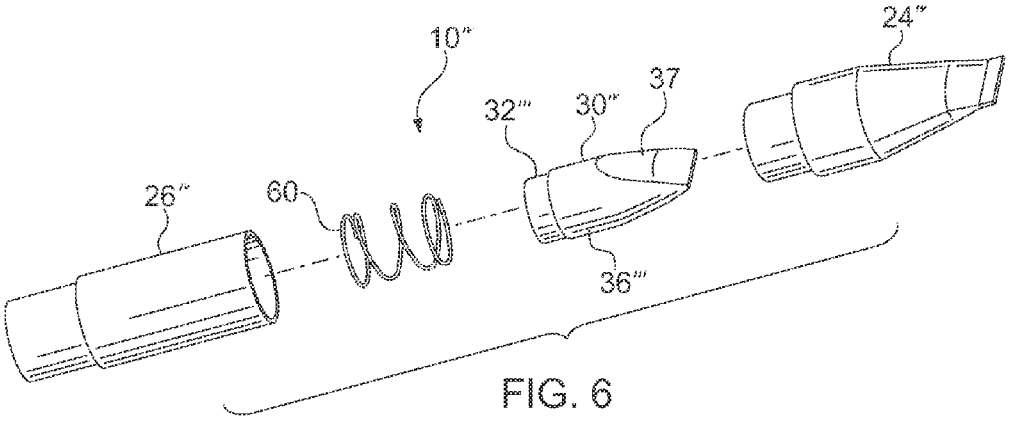
FIG. 6 is an exploded perspective view of a press-type dispensing container in accordance with another exemplary embodiment similar to the press-type dispensing container of FIGS. 5A-C.

Referring to FIG. 6, a press-type dispensing container $\mathbf{10}^{iv}$ in accordance with another exemplary embodiment of the invention will be described. The container $\mathbf{10}^{iv}$ is substantially the same as in the previous embodiment except that the outer case is formed of two separate parts, namely the hollow tube portion $\mathbf{26}^{iv}$ and the compressible region $\mathbf{24}^{iv}$ which are interconnected with the inner member 30''' therein. Such a multi-piece outer case may be utilized in any of the embodiments described herein.

While this invention has been described with an emphasis upon preferred embodiments, it will be obvious to those of ordinary skill in the art that variations in the preferred compositions and methods can be used and that it is intended that the invention can be practiced otherwise than as specifically described herein. Accordingly, this invention includes all modifications encompassed within the spirit and scope of the invention as defined by the claims that follow.

What is claimed is:

1. A press-type dispensing container comprising:

an outer case including a hollow tube portion defining an open end and a compressible region;

an inner member including a support portion configured to support a personal care product and move within the hollow tube portion; and a drive element positioned between the support portion and the compressible region of the outer case whereby compression of the compressible region engages the drive element and causes the support portion to move within the hollow tube portion toward the open end, wherein the personal care product is a solid, semi-solid, or waxy composition, and the personal care product is a stick form of any desired shapes.

2. The press-type dispensing container of claim 1 wherein the hollow tube portion is configured to receive a cap or lid.

3. The press-type dispensing container of claim 1 further comprising a personal care product in contact with the support portion.

4. The press-type dispensing container of claim 3 wherein the personal care product is selected from the group consisting of cosmetic, pharmaceutical, and cosmeceutical compositions.

5. The press-type dispensing container of claim 4 wherein the personal care product comprises a cosmetic composition selected from the group consisting of lipstick, lip balm, blush, foundation, eye shadow, concealer, eye liner, lip liner, deodorant, soap, fragrance, and sunscreen compositions.

6. The press-type dispensing container of claim 4 wherein the personal care product comprises a pharmaceutical composition.

7. The press-type dispensing container of claim 1 wherein the drive element comprises a flexible or elastic material.

8. The press-type dispensing container of claim 7 wherein the flexible or elastic material is selected from the group consisting of cross-linked latex rubber, cross-linked synthetic elastomers, non-cross-linked synthetic elastomers, natural rubber, thermoplastic elastomers, PVC, synthetic rubber, polyurethane, latex rubber, synthetic latex rubber, and polyolefins.

9. The press-type dispensing container of claim 7 wherein the inner member includes a flexible portion extending from the support portion to define a chamber and the flexible or elastic material is positioned within the chamber.

10. The press-type dispensing container of claim 1 wherein the drive element comprises a fluid.

11. The press-type dispensing container of claim 10 wherein the inner member includes a flexible portion extending from the support portion to define a chamber and the fluid is positioned within the chamber.

12. The press-type dispensing container of claim 10 wherein the support portion fluidly seals against an inside surface of the hollow tube portion such that the fluid is sealingly contained.

13. The press-type dispensing container of claim 1, wherein the drive element comprises a rigid material having opposed tapered sides.

14. The press-type dispensing container of claim 13 wherein the tapered sides are aligned with the compressible region.

15. The press-type dispensing container of claim 13 wherein a spring is disposed between the outer case and the inner member such that it biases the inner member away from the open end.

16. The press-type dispensing container of claim 1 wherein the hollow tube portion and the compression region are manufactured as separate components which are connected to one another to form the outer case.

* * * * *